US010794593B2

(12) United States Patent
Tsao

(10) Patent No.: US 10,794,593 B2
(45) Date of Patent: Oct. 6, 2020

(54) VAPORIZATION PIPE FOR A KEROSENE LAMP

(71) Applicants: Po-Kai Tsao, New Taipei (TW); Chih-Fang Lee, New Taipei (TW)

(72) Inventor: Po-Kai Tsao, New Taipei (TW)

(73) Assignees: Po-Kai Tsao, New Taipei (TW); Chih-Fang Lee, New Taipei (TW)

( * ) Notice: Subject to any disclaimer, the term of this patent is extended or adjusted under 35 U.S.C. 154(b) by 305 days.

(21) Appl. No.: 15/913,573

(22) Filed: Mar. 6, 2018

(65) Prior Publication Data

US 2019/0101285 A1 Apr. 4, 2019

(30) Foreign Application Priority Data

Oct. 2, 2017 (TW) ..... 106214662 U

(51) Int. Cl.

| | |
|---|---|
| ***F23D 99/00*** | (2010.01) |
| ***F21V 37/00*** | (2006.01) |
| ***F23D 11/44*** | (2006.01) |
| ***F23D 11/46*** | (2006.01) |

(52) U.S. Cl.

CPC ..... *F23D 91/04* (2015.07); *F21V 37/0045* (2013.01); *F21V 37/0054* (2013.01); *F23D 11/445* (2013.01); *F23D 11/46* (2013.01); *F21V 37/0008* (2013.01); *F23D 2206/0026* (2013.01); *F23D 2206/0052* (2013.01); *F23D 2700/032* (2013.01); *F23D 2700/033* (2013.01)

(58) Field of Classification Search

USPC ..... 431/106

See application file for complete search history.

(56) References Cited

U.S. PATENT DOCUMENTS

| | | | | |
|---|---|---|---|---|
| 2,206,949 A * | 7/1940 | Giles | F23D 11/44 | 137/244 |
| 4,131,414 A * | 12/1978 | Curtis | F23D 3/08 | 431/104 |
| 2010/0216079 A1* | 8/2010 | Targoff | F23D 17/002 | 431/8 |

* cited by examiner

*Primary Examiner* — Steven B McAllister
*Assistant Examiner* — John E Bargero
(74) *Attorney, Agent, or Firm* — Sinorica, LLC

(57) ABSTRACT

A vaporization pipe for a kerosene lamp has an oil tube, a thermally conductive tube, and a first passage. The oil tube is made of steel and has a vaporization jet on a top of the oil tube. The thermally conductive tube is mounted in the oil tube and forms a first channel. The first passage is disposed between the oil tube and the thermally conductive tube. The steel oil tube can prevent the vaporization pipe from being softened and bent during the preheating of vaporization pipe or burning of the kerosene, and thus a useful lifetime of the vaporization pipe is prolonged. The thermally conductive tube is made of high-thermal-conductivity material for keeping the vaporization pipe with adequate thermal conductivity and improving a burning rate of kerosene. The first passage allows the kerosene to flow upward, preventing the kerosene from being vaporized incompletely because the kerosene is over pressurized.

15 Claims, 5 Drawing Sheets

VAPORIZATION PIPE FOR A KEROSENE LAMP

CROSS-REFERENCE TO RELATED APPLICATIONS

This application is based upon and claims priority under 35 U.S.C. 119 from Taiwan Patent Application No. 106214662 filed on Oct. 2, 2017, which is hereby specifically incorporated herein by this reference thereto.

BACKGROUND OF THE INVENTION

1. Field of the Invention

The present invention relates to a vaporization pipe for a kerosene lamp, especially to a vaporization pipe comprising a steel oil tube and a thermally conductive tube mounted in the steel oil tube.

2. Description of the Prior Arts

A kerosene lamp was the main tool for illuminating before the electric light was popularized. As the electricity supply has nowadays been very convenient, the kerosene lamp may be used at a low frequency. However, the kerosene lamp is still useful in some circumstances without electricity, e.g. climbing or camping.

Before work, a vaporization pipe of a kerosene lamp has to be preheated, which vaporizes kerosene in the kerosene lamp and thereby the vaporized kerosene is easy to burn. When the vaporization pipe is heated to a specific temperature, a pumping rod is pushed to pump an oil tank at a bottom of the kerosene lamp so that the kerosene in the oil tank is capable of being conveyed upward to the vaporization pipe. Then, the kerosene is vaporizing at a tiny vaporization jet formed on a top surface of the vaporization pipe. After that, the vaporizing kerosene is burned at a high temperature and thus generates a flame to heat up a mantle for illumination. When the kerosene lamp is stopped using, a valve of the kerosene lamp should be closed and a pressure in the vaporization pipe should be relieved until the kerosene in the vaporization pipe is burned out, and the vaporization jet is penetrated by a needle to clean the vaporization jet and prevent carbon from accumulating in the vaporization jet.

Generally, the vaporization pipe is a copper tube for prompt preheating. However, during burning of the kerosene, heat generated by the flame is transmitted to the vaporization pipe through radiation, so a temperature at a side of the vaporization pipe facing to the flame may be increased and thereby the copper tube becomes softer to be bent by itself. If the vaporization pipe is bent, the needle may not be aligned to the vaporization jet and thus, when the vaporization jet is cleaned by the needle, the needle may penetrate the top surface of the vaporization pipe and enlarge the vaporization jet. If a diameter of the vaporization jet is too big, the kerosene may not be capable of vaporizing in the enlarged vaporization jet and thus the vaporization pipe should be replaced with a new one. In addition, such a copper tube cannot endure higher temperature, so the luminance of the kerosene lamp may not be sustained further.

Besides, the vaporization pipe of the conventional kerosene lamp comprises a spring, a copper grid, or a cardboard therein for improving resistance force to the kerosene, which decreases a flowing rate of the kerosene in the vaporization pipe, thereby prolonging a heating and vaporizing duration of the kerosene. However, the spring, the copper grid, and the cardboard may not be securely combined with the vaporization pipe, so the needle may be interfered with and cannot align to the vaporization jet, which causes the vaporization jet and the needle to be worn off. Furthermore, after the spring, the copper grid, or the cardboard is used for a period, tar oil may be accumulated in the vaporization pipe and cannot be cleaned.

To overcome the shortcomings, the present invention provides a vaporization pipe for a kerosene lamp to mitigate or obviate the aforementioned problems.

SUMMARY OF THE INVENTION

The main objective of the present invention is to provide a vaporization pipe for a kerosene lamp that has longer lifetime and provides a brighter and more stable flame.

The vaporization pipe for a kerosene lamp comprises an oil tube and a thermally conductive tube. A material of the oil tube includes steel. The oil tube comprises a vaporization jet on a top portion of the oil tube. The thermally conductive tube is mounted in the oil tube and comprises a first channel. A material of the thermally conductive tube includes aluminum or copper. The first channel is formed through the thermally conductive tube. In addition, a first passage is formed between an inner wall of the oil tube and an outer wall of the thermally conductive tube.

Therefore, with the vaporization pipe comprising the steel oil tube, the temperature resistant and mechanical strength of the vaporization pipe are enhanced, so that the vaporization pipe may not become softer to be bent by itself during preheating of the oil tube or burning of the kerosene. Besides, with the thermally conductive tube mounted in the oil tube, the burning efficiency of the kerosene in the vaporization pipe is also enhanced. Furthermore, because an outer diameter of the thermally conductive tube is smaller than an inner diameter of the oil tube, a first passage is formed therebetween, and thus the kerosene can flow in the first passage, which prevents the kerosene from erupting vertically and vaporizing incompletely.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
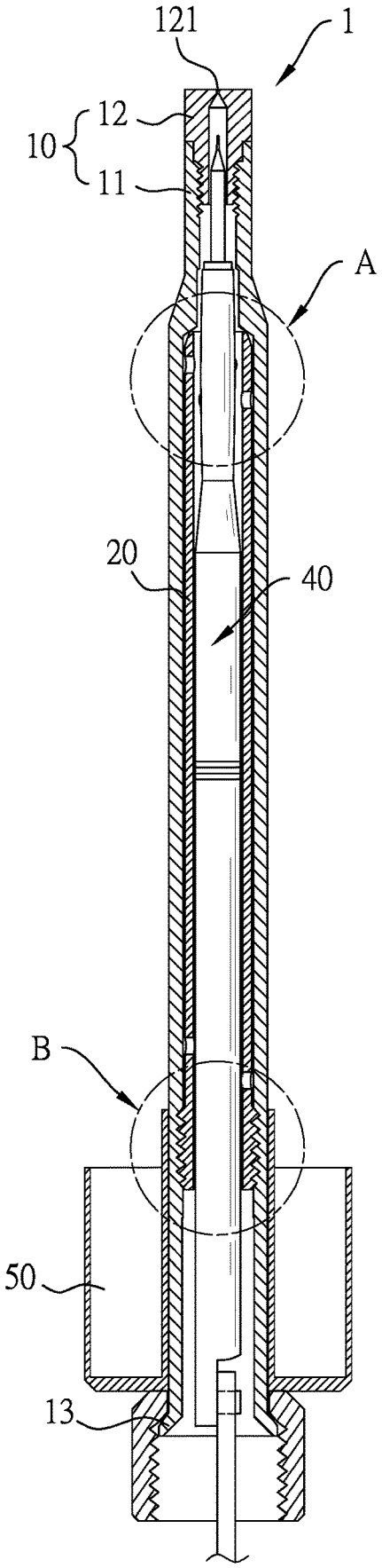
FIG. 1 is a sectional view of a vaporization pipe for a kerosene lamp in accordance with the present invention.
Figure 2:
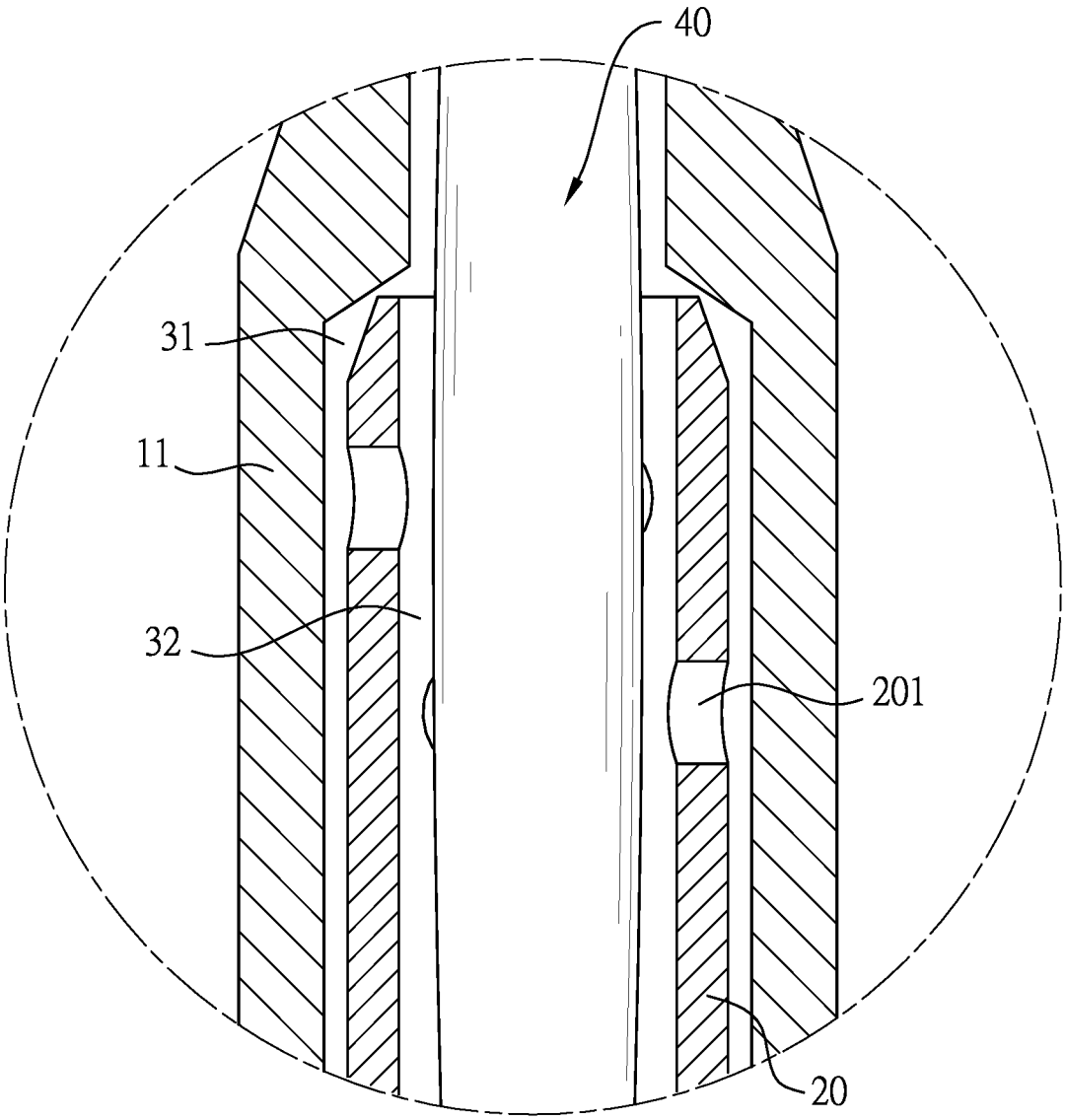
FIG. 2 is an enlarged view of the vaporization pipe in FIG. 1.
Figure 3:
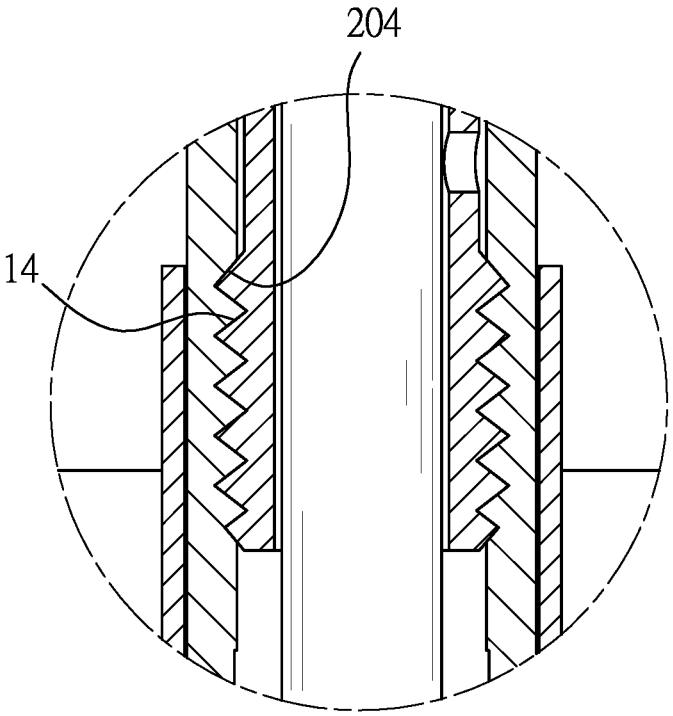
FIG. 3 is another enlarged view of the vaporization pipe in FIG. 1.

With reference to FIGS. 1 to 3, a vaporization pipe 1 for a kerosene lamp in accordance with the present invention comprises an oil tube 10, a thermally conductive tube 20, a needle 40, and a preheating bowl 50.

The oil tube 10 comprises a conduit 11, a vaporization shield 12, an annular stopper 13, and a threaded portion 14. The conduit 11 has a second channel 110 formed axially through the conduit 11, and two opposite ends of the conduit 11 are defined as a top end 111 and a bottom end 112. The vaporization shield 12 is detachably mounted on the top end 111 and in the second channel 110. A top surface of the vaporization shield 12 forms a vaporization jet 121. The annular stopper 13 radially protrudes out of the bottom end 112 of the conduit 11. The threaded portion 14 is formed on an inner wall of the oil tube 10 and between the top end 111 and the bottom end 112 of the conduit 11. Precisely, in this embodiment, the conduit 11 and the vaporization shield 12 are made of steel or steel alloy. In another embodiment, the vaporization shield 12 may be made of another material, such as copper. Because steel is high temperature resistant and has high mechanical strength, when the vaporization pipe 1 is preheated or the kerosene is burned, the oil tube 10 of the vaporization pipe 1 may not become softer to be bent by itself. Besides, the vaporization shield 12 can be substituted separately after wearing off, so the cost of maintenance may be reduced.

The thermally conductive tube 20 has a first channel 200 therein. The thermally conductive tube 20 is mounted in the second channel 110 of the oil tube 10. The thermally conductive tube 20 may be made of aluminum or aluminum alloy. Because aluminum has good thermal conductivity, the vaporization pipe 1 with said thermally conductive tube 20 can improve an efficiency of kerosene burning. The thermally conductive tube 20 comprises a plurality of first through holes 201, a plurality of second through holes 202, a plurality of annular grooves 203, and a threaded portion 204. The first through holes 201 are formed through an upper section of the thermally conductive tube 20. The second through holes 202 are formed through a lower section of the thermally conductive tube 20. The annular grooves 203 are formed on an outer surface of a middle section of the thermally conductive tube 20, and are separated from the first through holes 201 and the second through holes 202 at intervals. The middle section is between the upper section and the lower section of the thermally conductive tube 20. In the vaporization pipe 1, kerosene can pass through the second through holes 202 and flow to the first through holes 201 along the annular grooves 203, so that the kerosene is discharged stably. The threaded portion 204 is formed on the lower section of the thermally conductive tube 20, and the second through holes 202 are located between the annular grooves 203 and the threaded portion 204. The threaded portion 204 matches with and selectively engages with the threaded portion 14 of the oil tube 10, so the oil tube 10 and the thermally conductive tube 20 are fixed on each other by threaded connection.

An outer diameter of the thermally conductive tube 20 is smaller than an inner diameter of the oil tube 10 so a first passage 31 is formed between the inner wall of the oil tube 10 and an outer wall of the thermally conductive tube 20 when the thermally conductive tube 20 is mounted in the oil tube 10. The kerosene can flow upward through the first passage 31 after heated, which prevents the kerosene from erupting vertically and vaporizing incompletely.

The needle 40 is detachably mounted in both the second channel 110 of the oil tube 10 and the first channel 200 of the thermally conductive tube 20. An outer diameter of the needle 40 is smaller than an inner diameter of the thermally conductive tube 20, so a second passage 32 is formed between an inner wall of the thermally conductive tube 20 and the outer wall of the needle 40. With the first passage 31 and the second passage 32, the kerosene entering from a bottom of the vaporization pipe 1 can flow in two routes (i.e. the first passage 31 and the second passage 32), so the kerosene flowing in the kerosene lamp can contact the thermally conductive tube 20 and get heated. Besides, with aforesaid structure, the kerosene may flow stably and thereby a luminance of a flame is increased. The needle 40 comprises a connecting part 41, a driving part 42, and a needle part 43. One end of the connecting part 41 and one end of the driving part 42 are detachably combined. The connecting part 41 comprises at least one adjusting gasket 411 for adjusting a length of the needle 40. The driving part 42 comprises a fixing component 421 at another end of the driving part 42 that is distal from the connecting part 41. The needle part 43 is riveted on another end of the connecting part 41 that is distal from the driving part 42. In this embodiment, the connecting part 41 is made of copper or copper alloy, and the needle part 43 is made of steel or steel alloy.

Figure 4:
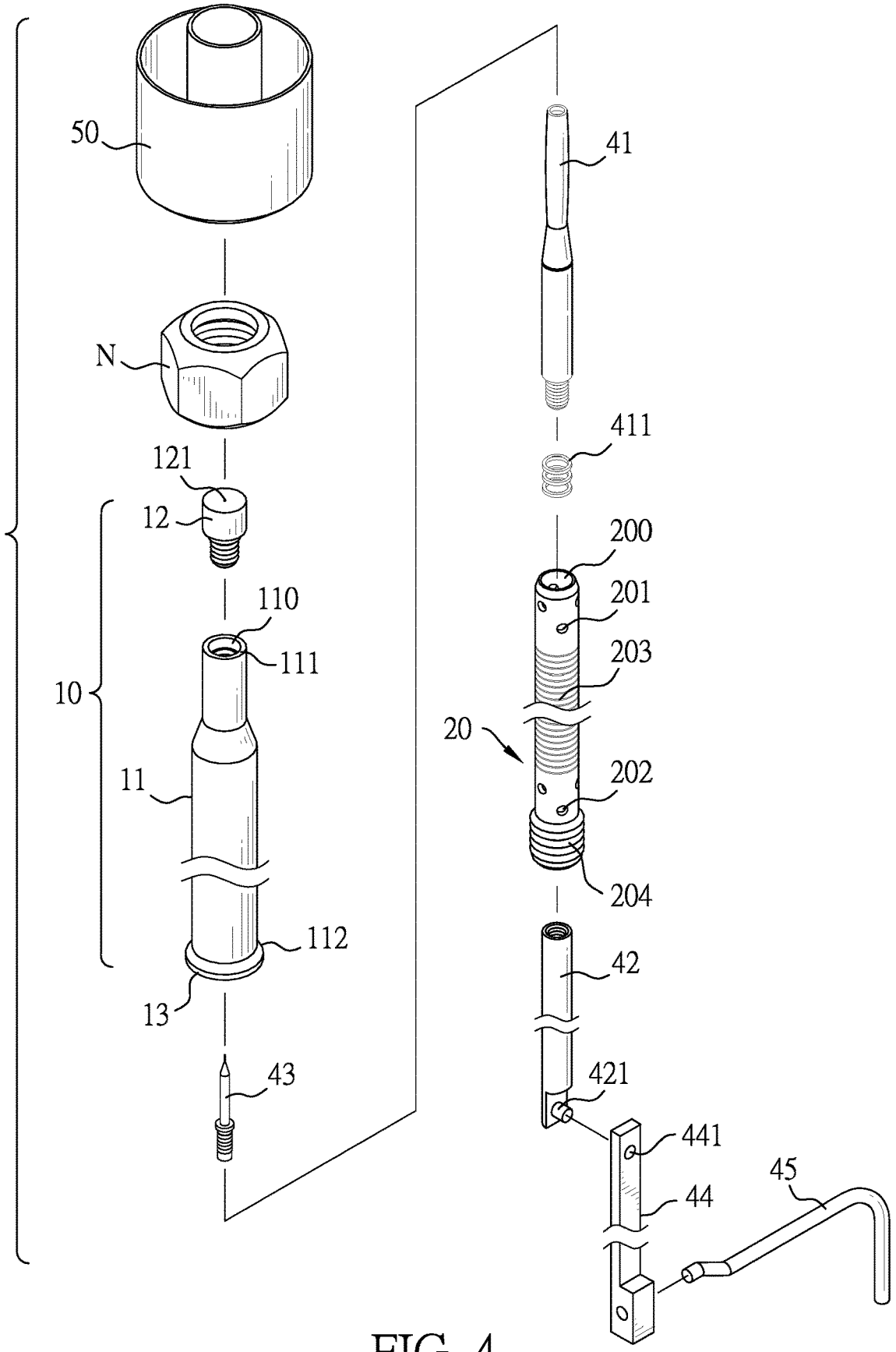
FIG. 4 is an exploded view of the vaporization pipe in FIG. 1.
Figure 5:
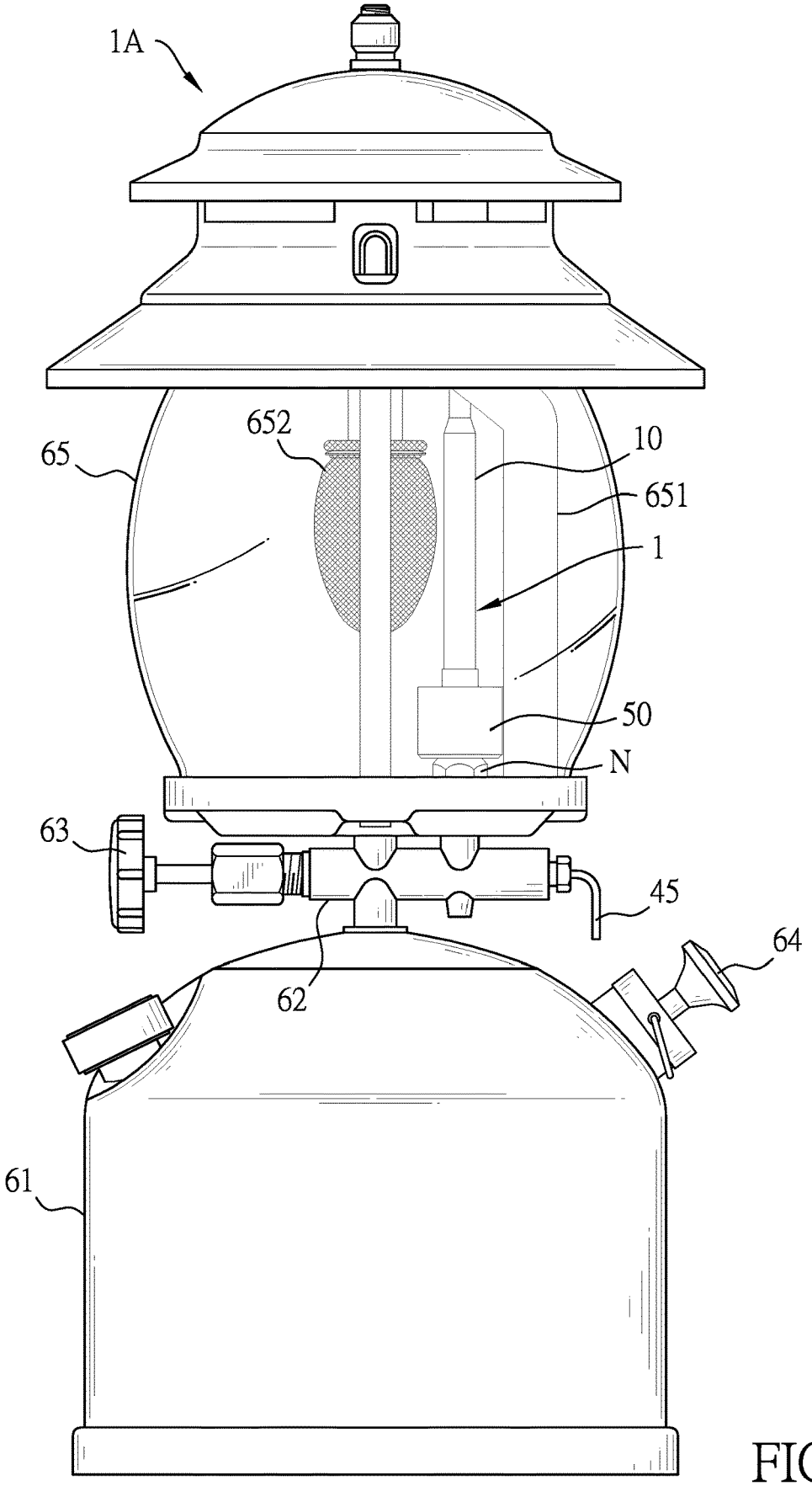
FIG. 5 is a sectional view of the vaporization pipe in FIG. 1 in operation.

Please refer to FIGS. 3 and 4, in this embodiment of the present invention, to remove foreign matter in the vaporization jet 121, the needle 40 further comprises a driven part 44 and an eccentric shaft 45. The driven part 44 comprises a fixing hole 441. The driven part 44 is detachably engaged with the fixing component 421 of the driving part 42 via the fixing hole 44. The eccentric shaft 45 is rotatably connected to the driven part 44. When the eccentric shaft 45 is rotated continuously, the eccentric shaft 45 can drive the driven part 44 and the needle 40 to reciprocate in an axial direction of the vaporization pipe 1 and drive a top end of the needle part 43 to pass through the vaporization jet 121 repeatedly so that the foreign matter in the vaporization jet 121 is removed and the vaporization jet 121 is cleaned. If the needle part 43 is broken after use for a long time, the needle part 43 with the combined connecting part 41 can be substituted separately, so the cost of maintenance may be reduced. However, the method of cleaning the vaporization jet 121 is not limited thereto, and the needle 40 can be driven by other means to reciprocate in the axial direction of the vaporization pipe 1 and remove tar oil and carbon stuck in the vaporization jet 121.

Then please refer to FIGS. 1 to 3 again. The preheating bowl 50 is detachably sleeved on the oil tube 10 and abuts on the annular stopper 13. Precisely, the preheating bowl 50 is an annular container made of copper or copper alloy.

Then please refer to FIGS. 3 and 4 again. The vaporization pipe 1 may be mounted in a kerosene lamp 1A. The kerosene lamp 1A further comprises an oil tank 61, an oil pipeline 62, a valve 63, a pump 64, and a lampshade 65. The oil tank 61 can accommodate kerosene. The oil pipeline 62 is connected to the oil tank 61. The valve 63 is mounted in the oil pipeline 62 and thereby the valve 63 can control the oil pipeline 62 to open or close. One end of the pump 64 is mounted in the oil tank 61 and another end of the pump 64 communicates with an exterior environment. The pump 64 comprises a flue (not shown in the drawings). The flue is connected to the end of the pump 64 that is mounted in the oil tank 61. A liquid level of the kerosene in the oil tank 61 should be lower than the flue of the pump 64. In the kerosene lamp 1A, the vaporization pipe 1 is connected to the oil pipeline 62 via a fixing means N, e.g. a nut. The lampshade 65 is connected to the oil pipeline 62 and comprises an air pipeline 651 and a wick 652. The air pipeline 651 comprises a first end and a second end. The first end of the air pipeline 651 communicates with the exterior environment. The second end of the air pipeline 651 is connected to the wick 652. The air pipeline 651 communicates with the vaporization pipe 1.

Please refer to FIGS. 3 and 4 again. When the kerosene lamp 1A is in use, the vaporization pipe 1 should be preheated. Precisely, alcohol is put into the preheating bowl 50 and burned to generate an alcoholic flame around the oil tube 10, which preheats the oil tube 10. The oil tube 10 is made of steel or steel alloy so that the oil tube 10 has good temperature resistance and mechanical strength to prevent the oil tube 10 from being bent by itself. However, the thermal conductivity of the oil tube 10 may be inadequate, so the thermally conductive tube 20 is made of high-thermal-conductivity material for improving a thermal conductivity of the vaporization pipe 1, which also improves a vaporizing rate and a burning rate of the kerosene. After the vaporization pipe 1 is heated to achieve a specific temperature that is capable of vaporizing the kerosene, the valve 63 should be turned on to make the pump 64 pressurize the kerosene in the oil tank 61 so that the kerosene is capable of passing through the oil pipeline 62 and into the preheated vaporization pipe 1. Then, the vaporization jet 121 vaporizes the kerosene, the vaporized kerosene flows into the air pipeline 651 and is mixed with air, and a kerosene flame is generated. Therefore, the kerosene flame passes through the air pipeline 651 to the second end of the air pipeline 651 and in the wick 652, and thereby the kerosene lamp 1A can have the illumination function. Even though the kerosene flame is close to the vaporization pipe 1, the oil tube 10 will not be softened and bent by the heat of the kerosene flame.

When the kerosene lamp 1A is stopped using, the valve 63 should be turned off first. After that, when the kerosene in the oil pipeline 62 is burned out, a pressure in the oil tank 61 should be relieved, and the eccentric shaft 45 should be rolled and thereby the needle 40 reciprocates in the axial direction of the vaporization pipe 1 and cleans the vaporization jet 121. In another embodiment, the needle 40 may be driven to reciprocate in the axial direction of the vaporization pipe 1 by other means.

Consequently, when the vaporization pipe 1 is preheated or the kerosene is burned, the steel oil tube 10 can maintain an original shape of the vaporization pipe 1, i.e. the vaporization pipe 1 may not be softened and bent by high temperature. Therefore, after the kerosene lamp is stopped using, the top end of the needle part 43 still can pass through the vaporization jet 121 of the oil tube 10 instead of penetrating the top surface of the vaporization shield 12 and enlarging the vaporization jet 121, which may make the vaporization pipe 1 unable to vaporize the kerosene.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A vaporization pipe for a kerosene lamp, the vaporization pipe comprising:

an oil tube, a material of the oil tube including steel; the oil tube comprising:

a vaporization jet on a top portion of the oil tube;

a thermally conductive tube mounted in the oil tube and including an upper section and a lower section opposite each other; the upper section closer to the vaporization jet than the lower section; the thermally conductive tube comprising:

a first channel formed through the thermally conductive tube;

a plurality of first through holes formed through the upper section;

a plurality of second through holes formed through the lower section; and a first passage formed between an inner wall of the oil tube and an outer wall of the thermally conductive tube.

2. The vaporization pipe as claimed in claim 1, wherein a material of the thermally conductive tube includes aluminum or copper.

3. The vaporization pipe as claimed in claim 1, wherein the thermally conductive tube includes a middle section between the upper section and the lower section of the thermally conductive tube, and the thermally conductive tube comprises:

a plurality of annular grooves formed on an outer surface of the middle section of the thermally conductive tube.

4. The vaporization pipe as claimed in claim 2, wherein the thermally conductive tube includes a middle section between the upper section and the lower section of the thermally conductive tube, and the thermally conductive tube comprises:

a plurality of annular grooves formed on an outer surface of the middle section of the thermally conductive tube.

5. The vaporization pipe as claimed in claim 1, wherein the thermally conductive tube comprises:

a threaded portion formed on the lower section of the thermally conductive tube.

6. The vaporization pipe as claimed in claim 4, wherein the thermally conductive tube comprises:

a threaded portion formed on the lower section of the thermally conductive tube.

7. The vaporization pipe as claimed in claim 5, wherein the oil tube comprises:

a threaded portion matching with and selectively engaging with the threaded portion of the thermally conductive tube.

8. The vaporization pipe as claimed in claim 6, wherein the oil tube comprises:

a threaded portion matching with and selectively engaging with the threaded portion of the thermally conductive tube.

9. The vaporization pipe as claimed in claim 8, wherein the second through holes are disposed above the threaded portion of the thermally conductive tube.

10. The vaporization pipe as claimed in claim 1, wherein the oil tube comprises:

a conduit including a top end and a bottom end opposite each other and comprising:

a second channel axially formed through the conduit; and a vaporization shield detachably mounted on the top end of the conduit and in the second channel; the vaporization shield comprising:

said vaporization jet on a top surface of the vaporization shield.

11. The vaporization pipe as claimed in claim 9, wherein the oil tube comprises:

a conduit including a top end and a bottom end opposite each other and comprising:

a second channel axially formed through the conduit; and a vaporization shield detachably mounted on the top end of the conduit and in the second channel; the vaporization shield comprising:

said vaporization jet on a top surface of the vaporization shield.

12. The vaporization pipe as claimed in claim 10, wherein the oil tube further comprises:

an annular stopper radially protruding out of the bottom end of the conduit;

wherein the vaporization pipe further comprises:

a preheating bowl detachably sleeved on the oil tube and abutted by the annular stopper.

13. The vaporization pipe as claimed in claim 11, wherein the oil tube further comprises:

an annular stopper radially protruding out of the bottom end of the conduit;

wherein the vaporization pipe further comprises:

a preheating bowl detachably sleeved on the oil tube and abutted by the annular stopper.

14. The vaporization pipe as claimed in claim 10, wherein the vaporization pipe further comprises:

a needle detachably mounted in the second channel and the first channel and comprising:

a connecting part;

a driving part detachably mounted on one end of the connecting part; and a needle part detachably mounted on another end of the connecting part; a top end of the needle part selectively passing through the vaporization jet; and a second passage formed between an outer wall of the needle and an inner wall of the thermally conductive tube.

15. The vaporization pipe as claimed in claim 13, wherein the vaporization pipe further comprises:

a needle detachably mounted in the second channel and the first channel and comprising:

a connecting part;

a driving part detachably mounted on one end of the connecting part; and a needle part detachably mounted on another end of the connecting part; a top end of the needle part selectively passing through the vaporization jet; and a second passage formed between an outer wall of the needle and an inner wall of the thermally conductive tube.

* * * * *